US007200900B2

(12) United States Patent
Berns

(10) Patent No.: US 7,200,900 B2
(45) Date of Patent: Apr. 10, 2007

(54) ARTICLE HAVING A CLOSURE SYSTEM

(75) Inventor: Jason Berns, Annecy (FR)

(73) Assignee: Salomon S.A., Metz-Tessy (FR)

( * ) Notice: Subject to any disclaimer, the term of this patent is extended or adjusted under 35 U.S.C. 154(b) by 59 days.

(21) Appl. No.: 10/869,887

(22) Filed: Jun. 18, 2004

(65) Prior Publication Data

US 2005/0183247 A1 Aug. 25, 2005

(30) Foreign Application Priority Data

Jun. 20, 2003 (FR) ..... 03 07464

(51) Int. Cl.
*A44B 19/00* (2006.01)

(52) U.S. Cl. ..... 24/432

(58) Field of Classification Search ..... 2/96, 2/108, 85, 83, 94; 24/381, 389, 4, 432
See application file for complete search history.

(56) References Cited

U.S. PATENT DOCUMENTS

| | | | | |
|---|---|---|---|---|
| 1,991,943 | A * | 2/1935 | Keviczky | 24/389 |
| 2,388,516 | A * | 11/1945 | Altobelli | 2/247 |
| 2,671,903 | A * | 3/1954 | Breul | 112/475.21 |
| 3,003,445 | A * | 10/1961 | Crystal | 112/475.16 |
| 3,409,953 | A * | 11/1968 | Briscoe | 24/389 |
| 3,685,103 | A * | 8/1972 | Severino | 24/381 |
| 3,859,150 | A * | 1/1975 | Van Amburg | 156/66 |
| 3,968,523 | A * | 7/1976 | Newman | 2/252 |
| 4,359,008 | A | 11/1982 | Newman | |
| 5,008,986 | A * | 4/1991 | Laudet et al. | 24/389 |
| 5,444,898 | A * | 8/1995 | Norvell | 24/389 |
| 5,509,147 | A | 4/1996 | Busquets | |
| 6,363,531 | B1 | 4/2002 | Quinn | |
| 6,571,432 | B1 * | 6/2003 | Rindle | 24/432 |
| 6,766,565 | B2 * | 7/2004 | Crye et al. | 24/381 |
| 6,948,207 | B2 * | 9/2005 | Daly | 5/738 |
| 2002/0116742 | A1 | 8/2002 | Quinn | |

FOREIGN PATENT DOCUMENTS

| | | |
|---|---|---|
| DE | 201 18 165 U1 | 3/2002 |
| FR | 2 646 760 | 11/1990 |
| WO | WO-97/39644 | 10/1997 |

* cited by examiner

*Primary Examiner*—James R. Brittain
(74) *Attorney, Agent, or Firm*—Greenblum & Bernstein, P.L.C.

(57) ABSTRACT

An article having an opening equipped with a slide fastener type closure system, the opening being defined by a cutout having a generally rectilinear central portion and at least one end portion extending in a direction that is substantially perpendicular to the central portion, the cutout defining a flap capable of covering at least a portion of the slide fastener.

27 Claims, 5 Drawing Sheets

ARTICLE HAVING A CLOSURE SYSTEM

CROSS-REFERENCE TO RELATED APPLICATION

This application is based upon French Patent Application No. 03.07464, filed Jun. 20, 2003, the disclosure of which is hereby incorporated by reference thereto in its entirety and the priority of which is hereby claimed under 35 U.S.C. §119.

BACKGROUND OF THE INVENTION

1. Field of the Invention

The invention relates to a closure system, particularly of the slide fastener type, impermeable or at least protected against wind and penetration of water and snow, as well as to a garment or other article, such as a backpack, equipped with such a closure system.

2. Description of Background and Relevant Information

Closure systems, particularly of the slide fastener or zipper type, are widely used on numerous types of articles, and more particularly, on garments, footwear articles, bags, etc.

For all these products, there is, in certain cases, a problem of having slide fasteners that are impermeable or at least resistant to the penetration of wind, water, snow, etc.

Generally, this problem is resolved by adding additional flaps covering the zipper. If these flaps are to render the slide fastener truly impermeable, it is often necessary to provide two mutually covering flaps and a connecting means of the self-gripping type, such as snap fasteners, etc.

Furthermore, the flaps pose a risk of blocking the slide fastener, as the slide thereof tends to become engaged in the material of these flaps. Not only do these ill-timed blockings hinder the proper functioning of the slide fastener, they can also lead to its destruction. Moreover, if they are used in an impermeable construction, all the seams must be made impermeable by special sealing films. Finally, constructions with flaps are bulky, cumbersome, and limit the possibilities for aesthetic choices.

In the document DE 201 18 165.7 and in U.S. Pat. No. 6,571,432, it has been proposed to position the slide fastener inside of the flap itself. This construction is particularly satisfactory; however, as is the case with all solutions proposing flaps, it requires the addition of yokes that are always difficult and expensive to make impermeable.

It is also known from the document FR 2 646 760 and U.S. Pat. No. 5,008,986 to construct a slide fastener, constituted of support tapes and teeth or links borne by these support tapes in which the links are only located on the side of the tape adapted to be turned inward of the article on which the slide fastener is mounted, the pull tab being constructed and arranged such that it can be manipulated from the outside of the article.

Such a fastener has an improved resistance to water penetration because its links are protected and can no longer channel water inward from the outside. This resistance can be further improved by providing an impermeable coating, on the side turned outward of the support tapes. Such fasteners are known to be particularly resistant to water penetration and are allowed for use without a protective flap on impermeable garments. However, depending on the construction and the mounting, such a fastener can pose slight risks of "leakages" depending on the amount of clearance remaining between the contiguous edges of the two tapes.

SUMMARY OF THE INVENTION

An object of the present invention is to overcome the aforementioned drawbacks and to propose a slide fastener closure system which, in particular, makes it possible to improve the resistance to wind and to snow and water penetration, while being inexpensive or less expensive to manufacture.

This object is achieved in an article having an opening equipped with a slide fastener type closure, with the opening comprising a cutout having a generally rectilinear central portion and at least one end portion extending in a direction that is substantially perpendicular to the central portions and the cutout having a flap that is capable of covering at least a portion of the slide fastener.

Indeed, the fact that it is the very cutout of the opening that defines a flap for protecting the slide fastener makes it possible to avoid the need for additional yokes and seams to make this flap.

As a result, there is reduction in the material, thickness, and manufacturing steps.

Furthermore, the effect obtained is much neater, "seamless," and, therefore, it is more aesthetic.

BRIEF DESCRIPTION OF DRAWINGS

The invention will be better understood and other characteristics thereof will become apparent from the following description, taken together with reference to the attached schematic drawings showing, by way of non-limiting examples, several preferred embodiments, and in which.

DETAILED DESCRIPTION OF THE INVENTION

Figure 1:
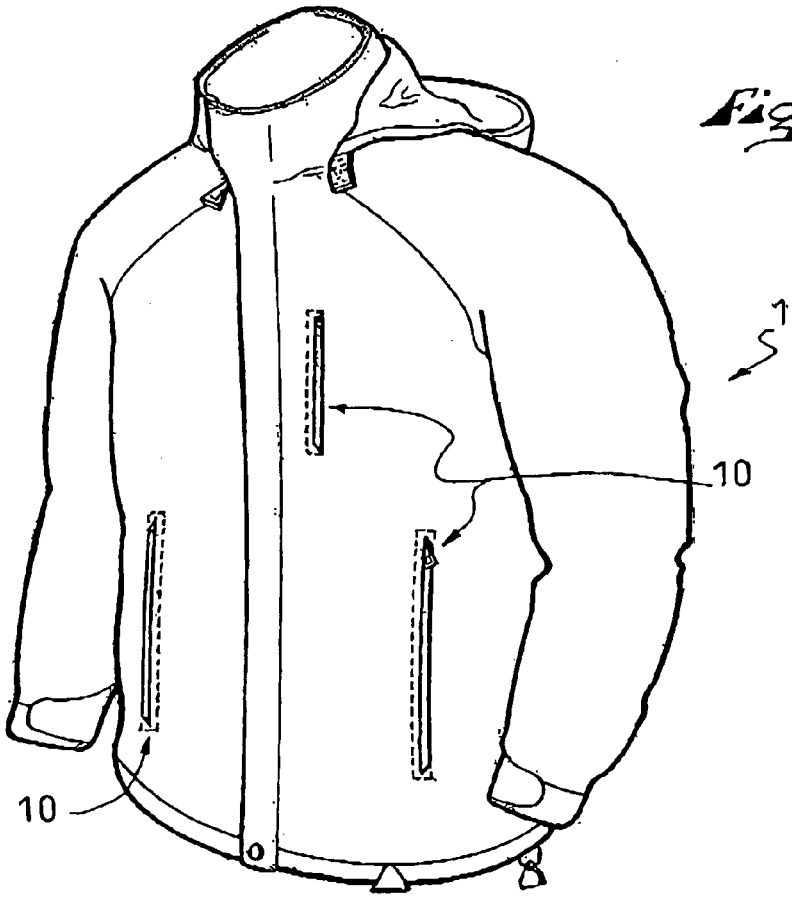
FIG. 1 is a perspective view of a jacket incorporating closure systems according to the invention.
Figure 1A:
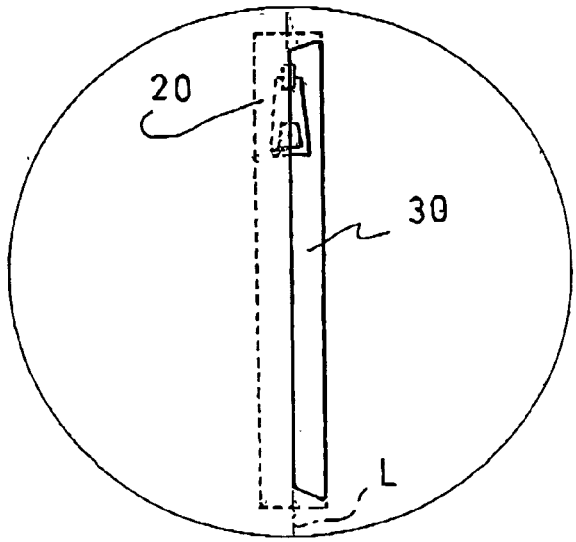
FIG. 1*a* is a detailed view of FIG. 1
Figure 2:
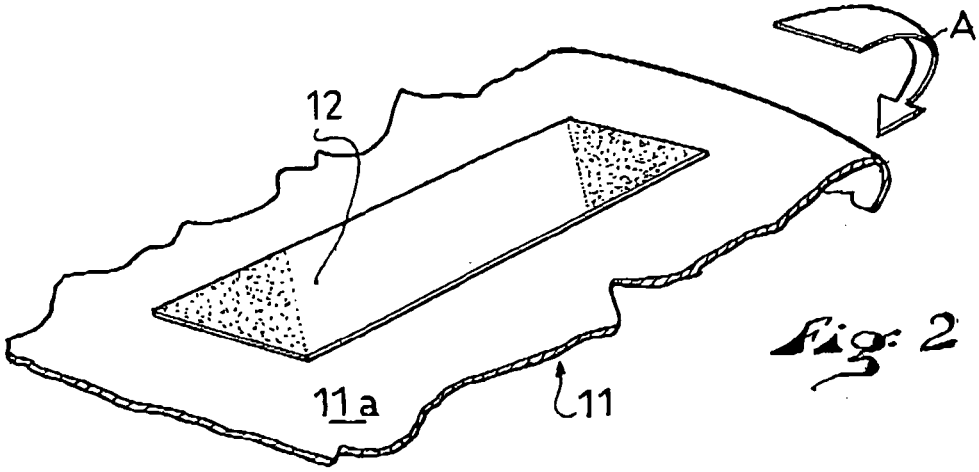
FIGS. 2–7 are perspective views showing the various steps in manufacturing a closure system according to a first embodiment.

FIGS. 1 and 1*a* show the application of a closure system according to the invention to a garment, in this case a jacket 1. This jacket is provided with various closure systems 10 equipped with slide fasteners 30, such as zippers, each of these fasteners being at least partially covered by a flap 20.

As shown particularly in FIG. 1, each flap 20 can be made to cover at least half of the slide fastener 30 and, therefore, extends at least up to the longitudinal median axis L of the fastener. That is as shown in FIG. 1, the flap 20 has a longitudinal edge that extends along the length of the slide fastener 30 and covering at least a portion of the slider and pull tab of the slide fastener. As shown in FIG. 1, a portion of the pull tab can be exposed for access to the slide fastener by the user. Stated another way, the opening which exposes a portion of the slide fastener 30, one edge of which is formed by the longitudinal edge of the flap 20, has a width that is smaller than, and laterally offset with respect to, the width of the two tapes of the slide fastener 30.

As shown more particularly in FIG. 1*a*, and as will be explained in more detail later, each flap 20 comes from a mere cutout of the fabric constituting the jacket, and is therefore produced without requiring additional yokes or seams.

FIGS. 2–7 show the various steps in manufacturing a closure system 10 according to the invention and its application to the material 11 constituting the outer envelope of the article.

Initially, an adhesive film strip 12 is applied and secured by adhesive/glue to the inner surface or "wrong" side 11*a* of the material 11, in the location of the future closure system. The film 12, in this example, is a film made of a thermoplastic material, such as polyurethane, polyamide, polyester, etc. This can be a film marketed by Bemis Corporation under the trade mark "SEWFREE®," for example.

As known, the material 11 provided with the adhesive film 12 can be glued to another material by means of this adhesive film by applying a pressure and a temperature that are predetermined as a function of the materials to be assembled and the adhesive film 12.

The material 11 covered with the adhesive film 12 is then turned over (see arrow A—FIG. 2) and cut out on its outer surface 11*b* by means of a cutting tool 40 of a known type, such as a knife, water jet, laser beam, or a blanking die.

Figure 3:
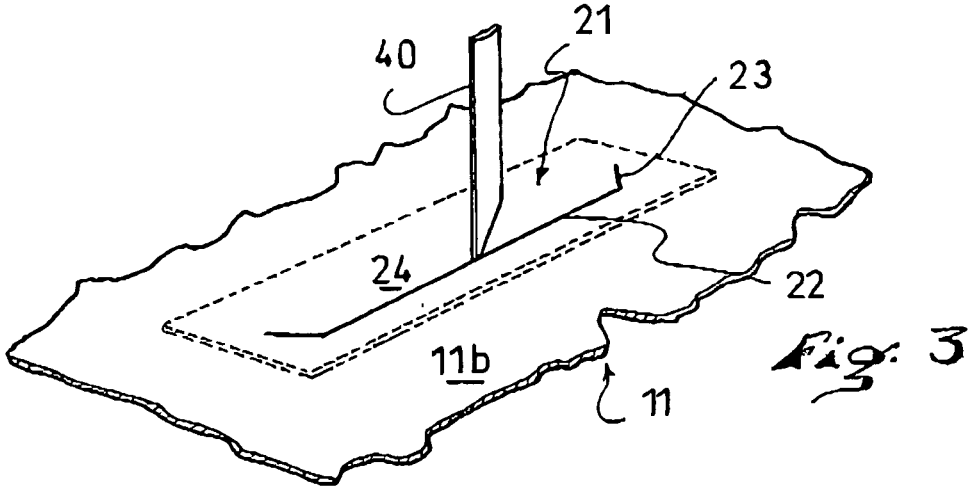

FIG. 3 shows this cutout, made in this case by means of a knife 40.

As shown in FIG. 3, a cutout 21 is obtained, which has a generally rectilinear central portion 22 and two end portions 23 extending in a direction that is substantially perpendicular to the central portion, and in this case slightly oblique.

As the case may be, a single end portion 23 could be provided.

The shape of the end portions 23 can be different. For example, they can be in the form of an arc of a circle, etc., as long as they extend in a different direction than that of the central portion 22 of the cutout, so as to define a flap 24 that is capable of covering at least a portion of the slide fastener.

Figure 5:
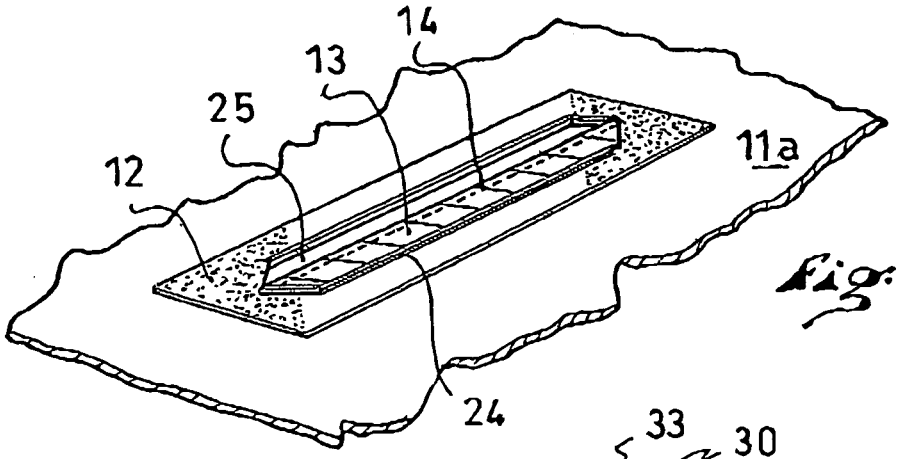

As shown in FIG. 5, the flap 24 can be made to be at least partially folded over itself. In this case, the end portions 23 of the cutout make it possible to define the degree of folding of the flap 24, this folding defining an opening 25 of a certain width, through which the slide fastener 30 is accessible.

Preferably, although non-limiting, the flap 24 is at least partially reinforced by a band 13 or other reinforcing strip.

Figure 4:
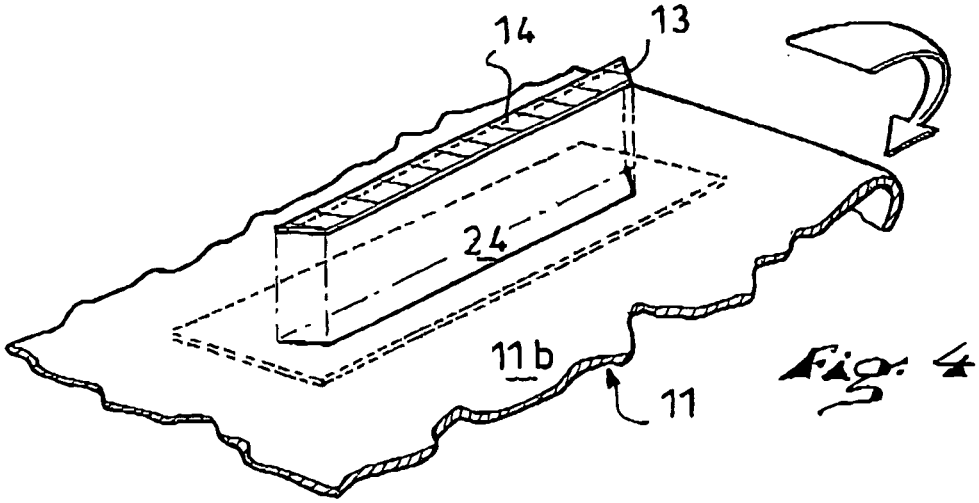

In this case, and as shown in FIGS. 4 and 5, the band 13 is first attached by a seam 14, such as stitching, along the flap 24, on the outer surface 11*b* of the material, and the flap 24/band 13 assembly is then folded on the wrong side, i.e., the inner surface 11*a* of the material 11. The band 13 could also be attached to the flap 24 by glue or other adhesive.

Figure 8:
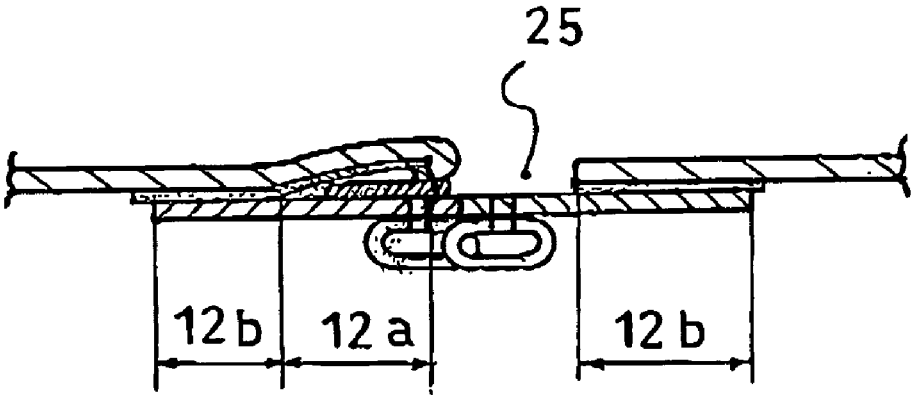
FIG. 8 is a cross-sectional view taken along the line VIII—VIII of FIG. 7.

The application of pressure and temperature then makes it possible to glue the flap 13, 24 on the wrong side 11*a* of the material 11, by means of the adhesive film 12, on a first gluing zone 12*a* (see FIG. 8).

Figure 6:
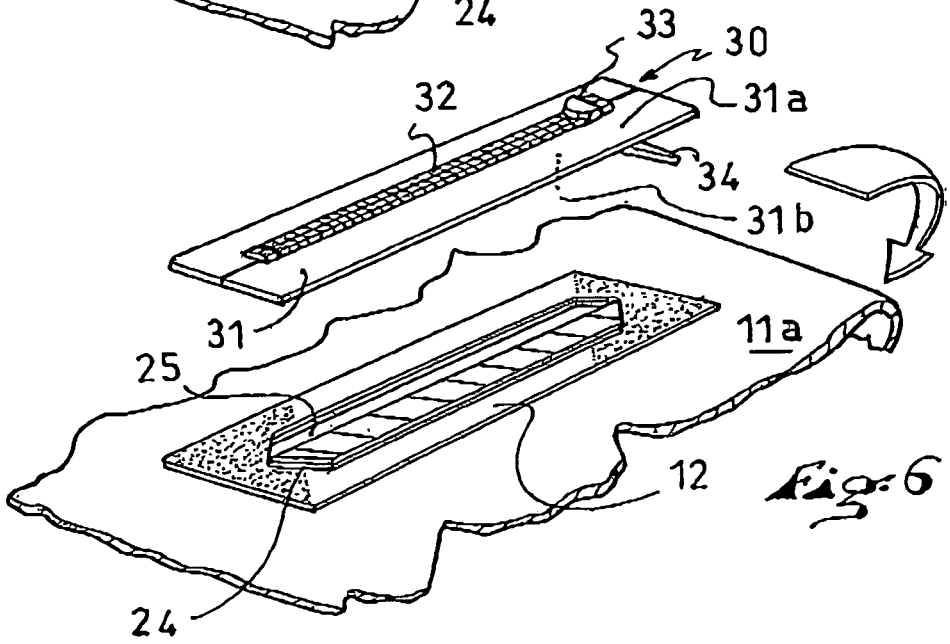

As shown in FIG. 6, the slide fastener 30 is then attached by gluing to the wrong side 11*a* of the material 11.

In the example shown, the slide fastener 30 comprises two tapes 31, links 32 located on the wrong side 31*a* of the tapes, and of a slide 33 whose pull tab 34 is located on the right side 31*b* of the tapes 31. As can be seen in FIG. 6, for example, the two longitudinally extending tapes 31 are removably joined together along a parting line by the links 32 that are secured to the tapes 31.

As described above, right side here means the side adapted to be located outside, whereas wrong side means the side adapted to be located inside of the garment or the like.

Such a slide fastener 30 construction is known as an inverted zipper, since the links 32 are found on the inside/wrong side of the garment, and is described particularly in the U.S. Pat. No. 5,008,986, commonly owned herewith.

It offers the advantage of guaranteeing a certain impermeability, which can be further improved by providing a polymeric coating, e.g., made of polyurethane, on the right or outer side 31*b* of the tapes 31.

A zipper construction of the classic type, non-inverted, could also be provided.

The zipper 30 is applied such that the right side 31*b* of the strips is facing the inner surface 11*a* of the material, the zone of the links 32 and slide 33 of the zipper straddling the opening 25, and the flap 24 and strips 31 being in contact with the adhesive film 12. It is then glued to the material 11 by means of an adhesive film 12, by applying a predetermined pressure and temperature in a second gluing zone 12*b*.

Figure 7:
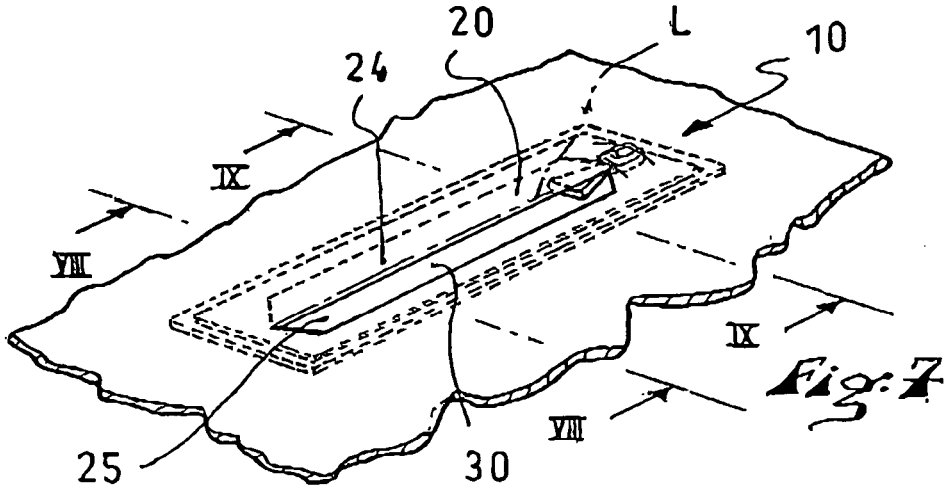

At the end, as shown in FIG. 7, one obtains a flap 24 that covers the slide fastener/zipper 30 over a portion of the width thereof, the flap 24 being obtained by a mere cutout and folding of the material 11 to which the fastener/zipper is applied.

The flap 24 is therefore obtained without adding material or an additional seam, except the provision of a reinforcing band or strip.

Depending on the material 11, the reinforcing band 13 could be eliminated.

The flap 24 covers the fastener 30 at least up to its longitudinal median axsi L, i.e., approximately 50% of the fastener. It could also cover a larger width of the latter, and at least 60% thereof, or even its entirety. In this latter case, the flap 24 simply comes from the cutout and is not folded over itself.

In the case where the slide fastener 30 is of the inverted type, as shown in the drawings, the effect obtained is very aesthetic, only the right side 31*b* of the tapes and a portion of the pull tab 34 of the fastener being visible.

Furthermore, as the flap 24, in any case, covers at least the junction zone L of the two tapes 31, additional impermeability is obtained.

Figure 9:
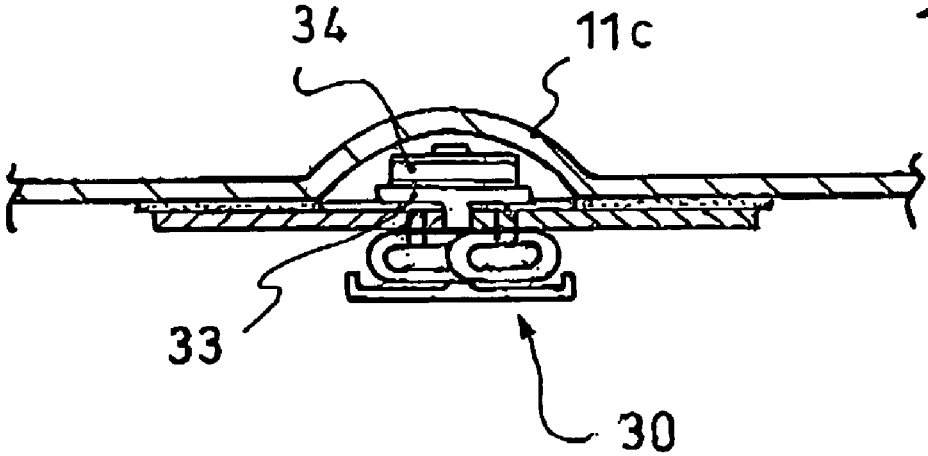
FIG. 9 is a cross-sectional view taken along the line IX—IX of FIG. 7.

As shown in FIG. 9, depending on the type of material 11 used, a deformation 11*c* thereof is obtained in the area of one end of the closure system 10 so as to provide housing for the slide 33 and the pull tab 34 of the slide fastener 30.

If necessary, this housing 11*c* can be obtained by adding an additional layer of material.

Figure 10:
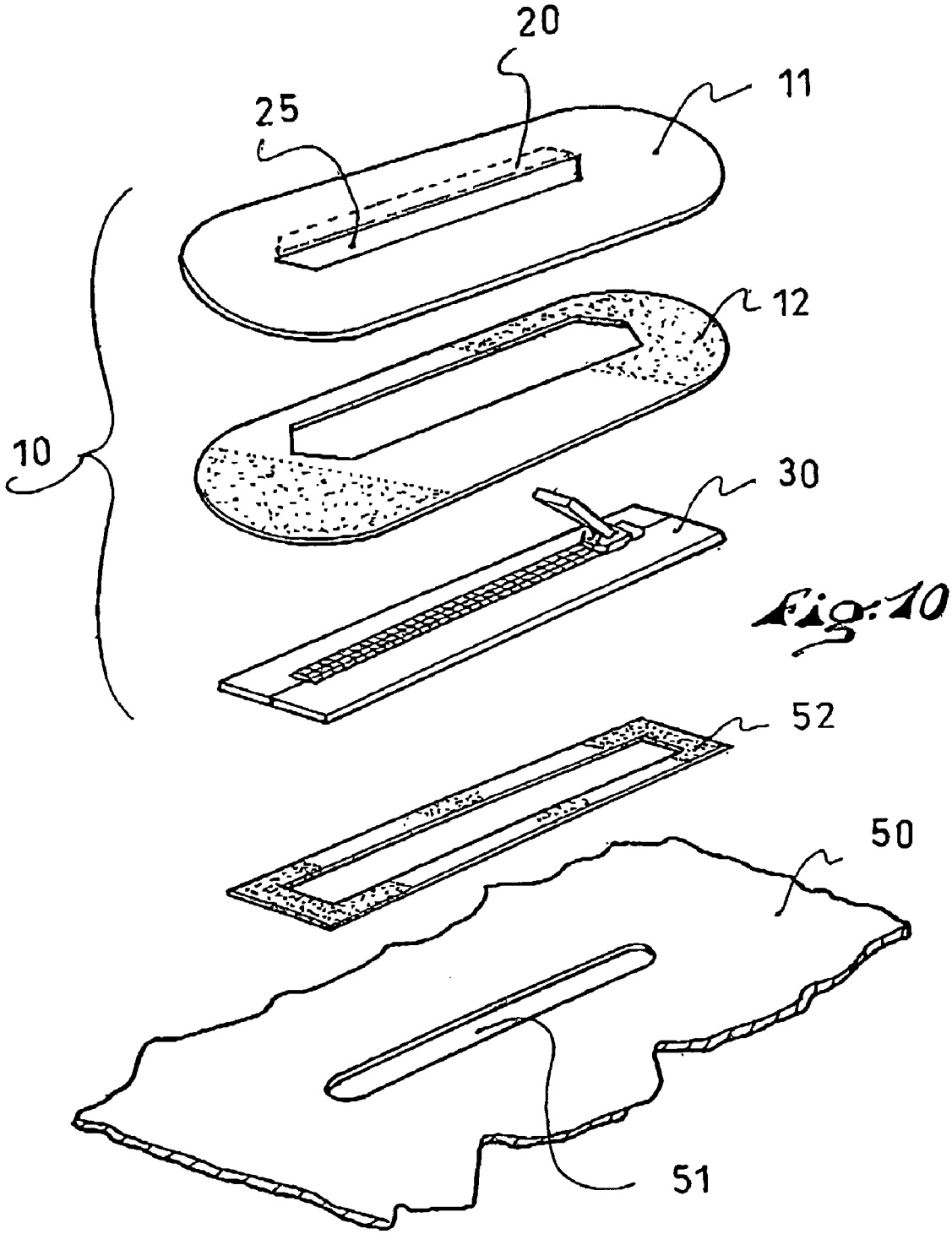
FIG. 10 is an exploded perspective view of a slide fastener according to a second embodiment.

FIG. 10 shows another embodiment in which similar or identical elements are designated by the same reference numerals.

In this example, the closure system 10 is obtained on a seperate piece of material 11, which is then attached by adhesive to an opening 51 of the garment 50 or the like, by means of an adhesive film 52 of the Bemis type.

Furthermore, the closure system 10 has exactly the same structure as described previously in connection with FIGS. 1–9.

In any case, the flap 24 is preferably oriented so as to protect the opening 25 from the prevailing effects of the outside elements. Thus, if the opening 25 is horizontal, the flap 24 will be provided along the upper edge thereof so as to form a sort of tile or cover that protects from rain.

The present invention is not limited to the particularly disclosed embodiments that have been described hereinabove by way of non-limiting examples, but it encompasses all similar or equivalent embodiments.

What is claimed is:

1. An article comprising:

a closure system comprising:

an opening;

a slide fastener closure for the opening, the opening providing access to the slide fastener;

the closure system having only one flap, said one flap covering only a portion of said slide fastener;

the opening being defined by a cutout comprising a generally rectilinear central portion and at least one end portion extending in a direction different from a direction of the central portion;

the cutout defining said flap.

2. An article according to claim 1, wherein:

the cutout comprises two end portions extending in a direction that is substantially perpendicular to the central portion.

3. An article according to claim 1, wherein:

each end portion has the shape of an arc of a circle.

4. An article according to claim 1, wherein:

the flap is partially folded over itself.

5. An article according to claim 1, wherein:

the flap is reinforced at least partially by a band.

6. An article according to claim 5, wherein:

the band is glued edge to edge to the flap.

7. An article according to claim 5, wherein:

the band is sewn onto an edge of the flap; and the flap is glued after folding.

8. An article according to claim 1, wherein:

the opening is provided directly in the material of the article.

9. An article according to claim 1, wherein:

the opening is provided as a separate piece of material that is attached by gluing to the outer surface of the article.

10. An article according to claim 1, wherein:

the slide fastener is attached by gluing.

11. A closure system according to claim 1, wherein:

the flap covers at least 60% of the slide fastener.

12. A closure system according to claim 1, wherein:

the flap covers at least 50% of the slide fastener.

13. A closure system according to claim 1, wherein:

the flap is oriented so as to protect the opening from prevailing effects of outside elements.

14. An article according to claim 1, wherein:

the at least one end portion extends in a direction substantially perpendicular to said generally rectilinear portion of said cutout.

15. An article according to claim 1, wherein:

the flap has a longitudinal edge extending lengthwise along the slide fastener.

16. An article according to claim 15, wherein:

the slide fastener comprises a pair of longitudinally extending tapes removably joined together along a parting line by links secured to the tapes;

the flap covers said parting line and the longitudinal edge of the flap is spaced transversely beyond said parting line.

17. An article comprising:

a piece of material having a longitudinal opening therethrough, said opening having a length, a width, an inner surface, and an outer surface;

a slide fastener comprising:

a pair of longitudinally extending tapes, each of said tapes having an outside and an inside, said outside of said tapes being connected to said inner surface of said piece of material for securing said slide fastener to said piece of material;

a series of links extending along a first of said pair of tapes and a series of links extending along a second of said pair of tapes;

a slider movable in a first direction along said series of links of said first and second tapes for engaging said links and moving said slide fastener to a closed position by bringing said pair of tapes together along a parting line, said slider being movable in a second direction along said series of links of said first and second tapes for disengaging said links for opening said slide fastener;

a pull tab connected to said slider and being located on said outside of said tapes for access to a user;

said opening having a width defined by two longitudinally extending edges, one of said two longitudinally extending edges comprising an edge of a flap, said flap being laterally offset from and covering said parting line between said tapes.

18. An article according to claim 17, wherein:

said article is a garment, said garment comprises a plurality of openings, each of said plurality of openings is closed by a respective one of a plurality of closure systems, each of said closure systems comprising a slide fastener.

19. An article according to claim 18, wherein:

said garment is a jacket; and said plurality of openings are located on a front of said jacket.

20. An article according to claim 18, wherein:

said edge of said flap is an upper edge of said opening when said garment is worn.

21. An article according to claim 18, wherein:

each of said closure systems of said plurality of openings only has one said flap.

22. An article according to claim 17, wherein:

said edge of said flap is an upper edge of said opening when said garment is worn.

23. An article according to claim 17, wherein:

said flap entirely covers said slider of said slide fastener.

24. An article according to claim 17, wherein:

said slide fastener is part of a closure system for said longitudinal opening, said flap is the only flap of said closure system.

25. An article according to claim 24, wherein:

said only flap of said closure system covers only partially a width of said slide fastener.

26. An article according to claim 17, wherein:

said article is a garment;

said piece of material forms an outer surface of said garment;

said flap is a cutout of said piece of material.

27. An article according to claim 17, wherein:

said article is a garment having an outer surface;

said piece of material is a piece of material separate from .and mounted on said outer surface of said garment.

* * * * *